US009570801B2

(12) United States Patent
Zhao et al.

(10) Patent No.: US 9,570,801 B2
(45) Date of Patent: Feb. 14, 2017

(54) DEVICE FOR REDUCING INTERFERENCE AMONG ANTENNAS OF MULTIPLE BASE STATIONS

(71) Applicant: ZTE Corporation, Shenzhen, Guangdong (CN)

(72) Inventors: Lijuan Zhao, Shenzhen (CN); Nan Shen, Shenzhen (CN); Zhanfu Li, Shenzhen (CN); Xianming Zhao, Shenzhen (CN)

(73) Assignee: ZTE Corporation, Shenzhen, Guangdong (CN)

( * ) Notice: Subject to any disclaimer, the term of this patent is extended or adjusted under 35 U.S.C. 154(b) by 0 days.

(21) Appl. No.: 14/761,933

(22) PCT Filed: Aug. 29, 2013

(86) PCT No.: PCT/CN2013/082586
§ 371 (c)(1),
(2) Date: Jul. 17, 2015

(87) PCT Pub. No.: WO2013/189454
PCT Pub. Date: Dec. 27, 2013

(65) Prior Publication Data

US 2015/0372379 A1 Dec. 24, 2015

(30) Foreign Application Priority Data

Jan. 30, 2013 (CN) ..... 2013 2 0052615 U

(51) Int. Cl.
*H01Q 1/12* (2006.01)
*H01Q 1/52* (2006.01)
(Continued)

(52) U.S. Cl.
CPC ..... *H01Q 1/526* (2013.01); *H01Q 1/1242* (2013.01); *H01Q 1/246* (2013.01); *H01Q 1/521* (2013.01); *H01Q 17/00* (2013.01)

(58) Field of Classification Search
CPC ..... H01Q 1/246; H01Q 1/125; H01Q 1/52; H01Q 1/1242; H01Q 1/521; H01Q 1/1235; H01Q 1/528; H01Q 21/062; H01Q 17/00; H01Q 1/084; H01Q 1/10; H01Q 9/40; H01Q 9/42
(Continued)

(56) References Cited

U.S. PATENT DOCUMENTS 6,198,460 B1 3/2001 Brankovic
8,364,105 B2 * 1/2013 McKay ..... H01Q 1/1221 343/878
(Continued)

FOREIGN PATENT DOCUMENTS

CN 2399833 Y 10/2000
CN 201167136 Y 12/2008
(Continued)

OTHER PUBLICATIONS

Supplementary European Search Report in European application No. 138077102, mailed on Dec. 21, 2015.
(Continued)

*Primary Examiner* — Linh Nguyen
(74) *Attorney, Agent, or Firm* — Oppedahl Patent Law Firm LLC

(57) ABSTRACT

A device for reducing interference among antennas of multiple base stations is provided, which includes an antenna module placed on a base station and configured to transmit and receive radio waves, a holding pole placed on the base station and configured to support the antenna module, a mounting bracket coupled to the antenna module and the holding pole, and a shielding apparatus placed on the holding pole or the antenna module and capable of being
(Continued)

adjusted in directions. The device has a simple structure; it is easy to manufacture and install the device; it can be applied to the base station's antennas in network use. In addition, the device can efficiently increase isolation and reduce interferences among the antennas of the multiple base stations.

13 Claims, 4 Drawing Sheets

(51) Int. Cl.
*H01Q 1/24* (2006.01)
*H01Q 17/00* (2006.01)

(58) Field of Classification Search
USPC ..... 343/841, 878, 890, 891, 892
See application file for complete search history.

(56) References Cited

U.S. PATENT DOCUMENTS 8,736,512 B2 * 5/2014 Grice ..... H01Q 1/125 343/878
2004/0027307 A1 2/2004 Hossein
2004/0135735 A1 * 7/2004 Naym ..... H01Q 1/18 343/882
2004/0217913 A1 11/2004 McCandless
2005/0057427 A1 * 3/2005 Wensink ..... H01Q 1/125 343/878
2006/0092090 A1 * 5/2006 Greenfield ..... H01Q 1/1228 343/890
2008/0048928 A1 * 2/2008 Michaelis ..... H01Q 1/125 343/892
2012/0325997 A1 12/2012 He
2014/0347246 A1 * 11/2014 Lewry ..... H01Q 1/1242 343/892
2015/0138022 A1 * 5/2015 Takahashi ..... H01Q 1/1242 343/702
2015/0229032 A1 * 8/2015 Liu ..... H01Q 15/23 343/766
2016/0211576 A1 * 7/2016 Vassilakis ..... H01Q 1/125

FOREIGN PATENT DOCUMENTS

CN 201319400 Y 9/2009
CN 102136620 A 7/2011
CN 202009068 U 10/2011
CN 202121069 U 1/2012
CN 102842745 A 12/2012
EP 0936693 A1 8/1999

OTHER PUBLICATIONS

International Search Report in international application No. PCT/CN2013/082586, mailed on Dec. 5, 2013.
English Translation of the Written Opinion of the International Search Authority in international application No. PCT/CN2013/082586, mailed on Dec. 5, 2013.

* cited by examiner

DEVICE FOR REDUCING INTERFERENCE AMONG ANTENNAS OF MULTIPLE BASE STATIONS

TECHNICAL FIELD

The present disclosure relates to the antenna technology of a base station in the field of mobile communications, and in particular to a device for reducing interference among antennas of multiple base stations.

BACKGROUND

In the field of communications, the same base station may have antennas of a plurality of communications systems. Due to restriction to geological locations, distances among some antennas are very small, leading to isolation reduction among antennas, giving a plurality of wireless signals a chance to simultaneously enter into a receiver, thus causing severe interferences to available signals. Therefore, improving isolations among antennas from different systems to enhance anti-interference capabilities has significantly crucial meanings to the communications system.

In communication systems, because of close distances among antennas and poor isolation, interferences exist among different base station systems. Hitherto there are mainly two solutions provided. One is to increase isolations among antennas by changing heights, distances and pitch angles of the antennas. Being restricted to the size of the space, degrees of difficulty for the construction and requirements for the coverage, the method is limited in terms of improvement. Another method is to improve the anti-interference of the technical index in the antenna design. This method is to change the design at the module phase and has difficulty in realization of antennas, thus being not suitable for the base station's antennas in network use.

Chinese patent (CN201010276357) describes an anti-interference wide-beam WLAN base station antenna, including a metal reflector, a microstrip plate fixed on the metal reflector through an insulating shore, and a radiate array antenna laid on the microstrip plate. The radiate array antenna includes a set of microstrip transmission lines laid on the back of the microstrip plate and a plurality of radiation units laid on the front of the microstrip plate and arranged in columns. The antenna involves a simple manufacture technology, has a light structure, needs a low cost, and is easy to be put into large-scale industrial production and broadened in the aspect of beam-width in the horizontal plane, as well as solves the interference problem between the same polarization when current available antennas of a vertically polarized kind are used in practice. The patent increases anti-interference to the design of the antenna per se, mainly aiming at the interference problem the same polarization of antennas of vertically polarized kind.

According to the Chinese patent (CN2399833), it discloses an apparatus for absorbing and shielding electromagnetic waves of a mobile phone antenna, including a half-shielding apparatus on an antenna body, wherein the apparatus mainly includes at least one small absorbing slice and a spacer which can efficiently shield electromagnetic waves directed to a user. An inner diameter of the spacer is not greater than an outer diameter of the antenna. The spacer is a metal slice or an absorbing material. The absorbing slice is connected to or embedded in the spacer. Outside the spacer there is a housing. The implementation process of the patent impacts a radiation pattern. The cell phone antenna is an omni-directional antenna. By shielding radiation signals radiated to a brain direction, the patent mostly lowers a detriment to a human body from the electromagnetic waves. The patent has greatly changed a main beam pattern per se, thus not being suitable to handle interferences among antennas of multiple base stations.

SUMMARY

In view of this, the present disclosure is intended to provide a device for reducing interference among antennas of multiple base stations, which can efficiently increase isolation among the antennas of the multiple base stations, thus reducing interferences among antennas of base stations.

To this end, the technical solutions of the present disclosure are implemented as follows.

The present disclosure provides a device for reducing interference among antennas of multiple base stations, which includes: an antenna module placed on a base station, and configured to transmit and receive radio waves; a holding pole placed on the base station, and configured to support the antenna module; a mounting bracket, coupled to the antenna module and the holding pole; and a shielding apparatus, placed on the holding pole or the antenna module, and capable of being adjusted in directions.

Furthermore, the shielding apparatus may be an apparatus that absorbs or shields an electromagnetic wave.

Furthermore, the shielding apparatus may include: a stretchable shielding plate; a first bracket coupled to the holding pole, wherein the first bracket is capable of sliding along an exterior of the holding pole; and a rotation shaft placed on the shielding plate, wherein the rotation shaft is hinged to the first bracket.

Preferably, the shielding plate may be composed of a plurality of reticular plates, and adjacent reticular plates uses sliding connection, and one of the plurality of the reticular plates is fixedly coupled with the rotation shaft.

Preferably, the shielding plate may be a folded plate which has an adjustable length.

Alternatively, the shielding apparatus may include: a stretchable shielding plate; a second bracket placed on the antenna module; and a connection sleeve placed on the shielding plate, wherein the connection sleeve is rotationally coupled to the second bracket.

Preferably, the shielding plate may be a folded plate which has an adjustable length.

Preferably, the shielding plate may be made of a metal material or an absorbing material.

Preferably, a length of the shielding plate may be 50%~80% of a length of a radome.

Preferably, the first bracket may be a stretchable bracket, and one end of the first bracket is equipped with a fixed sleeve placed on the holding pole.

In contrast to the prior art, the device for reducing interference among antennas of multiple base stations provided by the embodiments, according to the present disclosure, at least possesses following advantages:

1) the structure of the device for reducing interference among antennas of multiple base stations provided by the embodiments, according to the present disclosure, is simple; it is easy to manufacture and install the device; it can be applied to the base station's antennas in network use;

2) the shielding apparatus of the device for reducing interference among antennas of multiple base stations provided by the embodiments, according to the present disclosure, may carry out angle adjustments, thereby efficiently increasing isolation among the antennas of the multiple base stations and reducing interferences among antennas of base stations.

Figure 1:
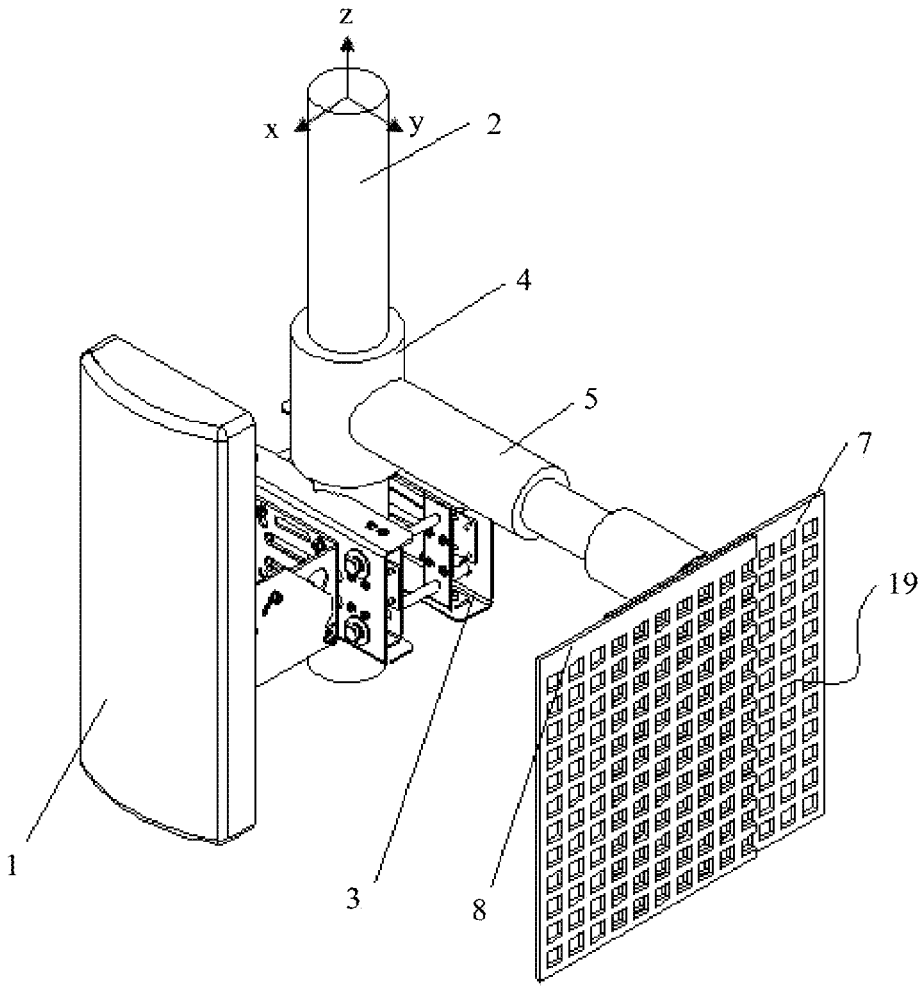
FIG. 1 is a structural diagram of a device for reducing interference among antennas of multiple base stations according to embodiment one of the present disclosure.

notes for reference signs: 1-antenna module; 2-holding pole; 3-mounting bracket; 4-fixed sleeve; 5-first bracket; 6-rotation shaft; 7-forward shielding plate; 8-backward shielding plate; 19-shielding plate; 20-second bracket; 21-connection sleeve.

DETAILED DESCRIPTION

Technical solutions of the present disclosure are further described with reference to the accompanying drawings and the embodiments of the present disclosure hereinafter. It is necessary to note that the embodiments and features thereof according to the present disclosure may be combined with each other if there is no conflict.

As shown in FIG. 1 to FIG. 7, a device for reducing interference among antennas of multiple base stations, according to the present disclosure, includes: an antenna module 1 placed on a base station, and configured to transmit and receive radio waves; a holding pole 2 placed on the base station, and configured to support the antenna module; a mounting bracket 3, coupled to the antenna module and the holding pole; and a shielding apparatus placed on the holding pole or the antenna module, and capable of being adjusted in directions.

Specifically, because of the interference problem among antennas of multiple base stations in the communications system of the prior art, the present disclosure employs the shielding apparatus among the antennas of the multiple base stations to increase isolation and reduce interferences among antennas of the base stations. The device for increasing isolation among the antennas of the base stations, according to the present disclosure, includes the antenna module, the mounting bracket, the holding pole and the shielding apparatus.

Furthermore, the antenna module uses the antenna module in the prior art, which is placed on the base station and consists of a reflection plate, a matched network, an antenna unit, and a connector, which are placed within a radome, and the radome, thus implementing the transmission and reception of the radio waves. The cylindrical holding pole is also placed on the base station, where a symmetry axis of which coincides with a z-axis. The antenna module is placed on the holding pole through the mounting bracket, forming a support to the antenna module. In addition, the shielding apparatus with functions of absorbing or shielding an electromagnetic wave can be placed either on the holding pole or on the antenna module. Furthermore, a spatial position of the shielding apparatus can be adjusted for the purpose of hindering an unnecessary signal of a frequency band and of directly connecting to a required signal of a frequency band, thus acquiring an optimal tuning position.

Since the shielding apparatus according to the present disclosure may be placed either on the holding pole or the antenna module, further description for the structure of the shielding apparatus placed either on the holding pole or the antenna module is given in combination with the specific embodiments hereinafter.

It is noted that, according to the present disclosure, structures or components with same or similar functions in each embodiment are denoted by the same reference signs in the drawings. Furthermore, a longitudinal direction involved in the present disclosure is the z-axis direction shown in FIG. 1, 3 or 5, and a horizontal direction involved is a y-axis or an x-axis direction shown in FIGS. 1, 3 and 5. Refer to each embodiment for specific description.

Embodiment One

Figure 2:
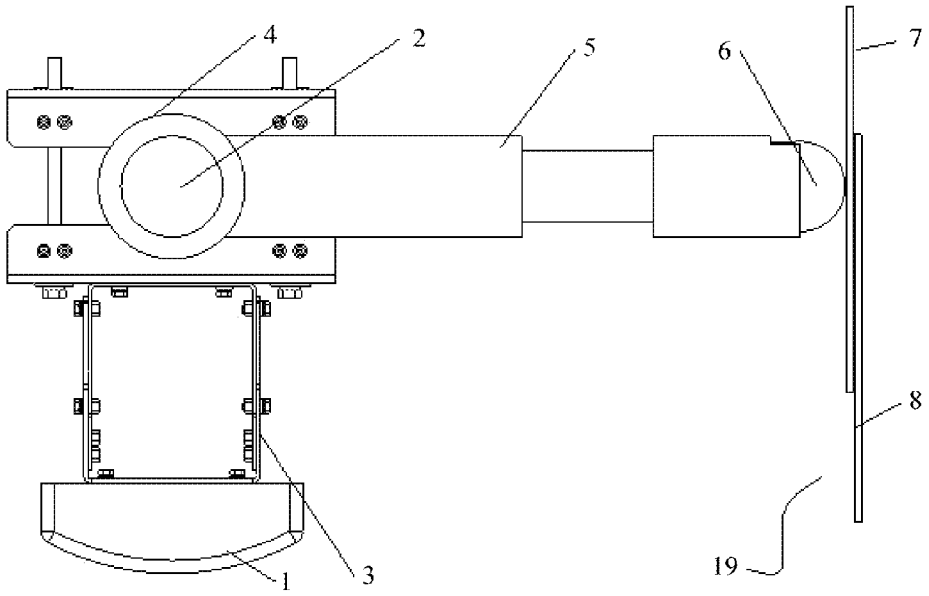
FIG. 2 is a top view of the device for reducing interference among antennas of multiple base stations as shown in FIG. 1.

FIG. 1 or 2 is a structural diagram of a device for reducing interference among antennas of multiple base stations according to the present disclosure, in which the shielding apparatus is placed on the holding pole.

In this embodiment, the shielding apparatus includes: a stretchable shielding plate 19; a first bracket 5 coupled to the holding pole 2, wherein the first bracket may slide along an exterior of the holding pole; and a rotation shaft 6 placed on the shielding plate, wherein the rotation shaft is hinged to the first bracket.

Specifically, as shown in FIG. 1, the first bracket, according to the embodiment, is stretchable along the y-axis. Preferably, it is made of an insulation material. One end of the first bracket is fixedly provided with a fixed sleeve 4, and the fixed sleeve is placed on the exterior of the holding pole of a cylindrical shape, as a result, the first bracket may horizontally slide up and down along the exterior of the holding pole, further adjusting the height of the shielding plate for the purpose of acquiring an optimal tuning position. In addition, the other end of the first bracket is provided with a spherical groove, where the rotation shaft of the spherical groove is placed in a rotation manner inside the groove of the first bracket, as a result, the rotation shaft may rotate horizontally and almost 360° in pitch angle inside the groove, thus bringing along a corresponding rotation of the shielding plate being fixed to it so that the shielding plate acquires the optimal spatial-tuning position. In addition, the relative position of the first bracket and the radome may be determined according to real application scenarios.

The shielding plate is composed of two reticular plates according to the present disclosure. As shown in FIG. 2, the two reticular plates include a forward shielding plate 7 and a backward shielding plate 8. In addition, the forward shielding plate 7 and the backward shielding plate 8 are overlapped with each other vertically and use sliding connection therebetween. Therefore, it is possible to make the two reticular plates stretch out horizontally along the x-axis in a push-and-pull manner in accordance with applications in site. In addition, when the two reticular plates are stretched out, a horizontal distance in the push-and-pull is finely tuned on the premise that a main beam pattern of the antennas of the base station will not be influenced and the isolations among the base stations will be optimally improved.

Furthermore, the backward shielding plate 8 or the forward shielding plate 7, is fixedly coupled with the rotation shaft using a sticky substance, or is fixedly coupled with the rotation shaft in other manners, as long as the manner in use can achieve reinforcement, windproof and prevention of ineffectiveness of the shielding apparatus due to execution of external forces. By way of fixedly coupling the backward shielding plate 8 or the forward shielding plate 7 with the rotation shaft, the shielding plate can rotate together with the rotation shaft, thus, the shielding plate can acquire the optimal tuning position. In addition, after the optimal tuning position is determined, the rotation shaft is locked using a fastener. Therefore, the rotation shaft cannot continue rotations inside the groove of the first bracket, efficiently preventing looseness.

In addition, the forward shielding plate 7 and the backward shielding plate 8 are shielding plates with a feature of frequency selection, which are made of a metal material with a feature of shielding electromagnetic waves, or are made of an absorbing material with a feature of absorbing electromagnetic waves. Mesh sizes of the forward shielding plate 7 and the backward shielding plate 8 vary with the frequency bands. A shape of a mesh, may be one or many of a square, a circle or any other geometric shapes. According to the present disclosure, in order to optimize the tuning performance of the shielding plate, a length of the shielding plate is 50%~80% of a length of the radome. Preferably, the length of the shielding plate is 67% of the length of the radome.

Embodiment Two

Figure 3:
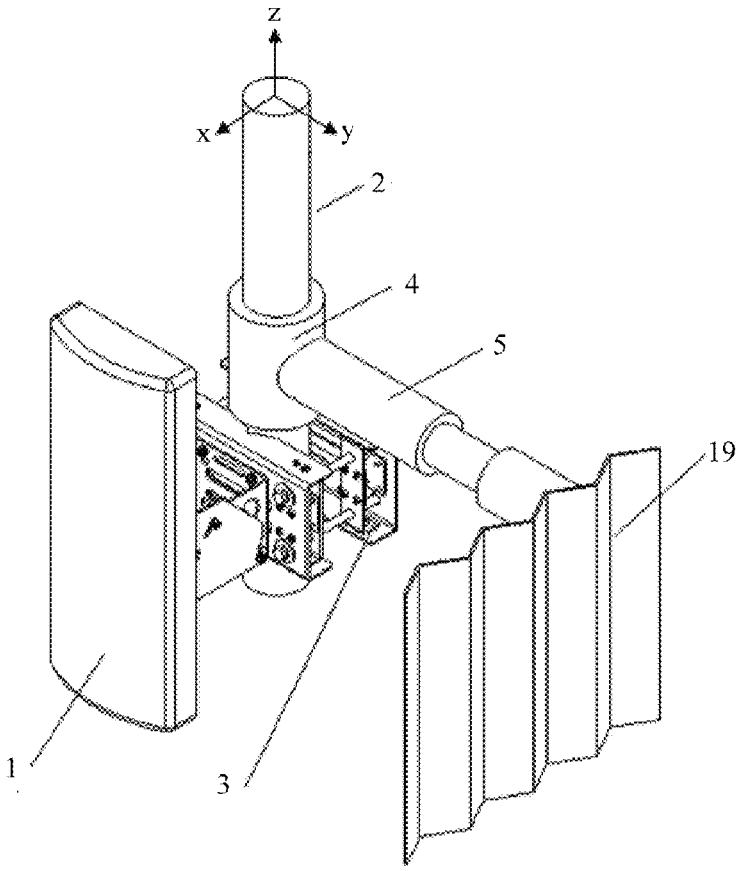
FIG. 3 is a structural diagram of a device for reducing interference among antennas of multiple base stations according to embodiment two of the present disclosure.
Figure 4:
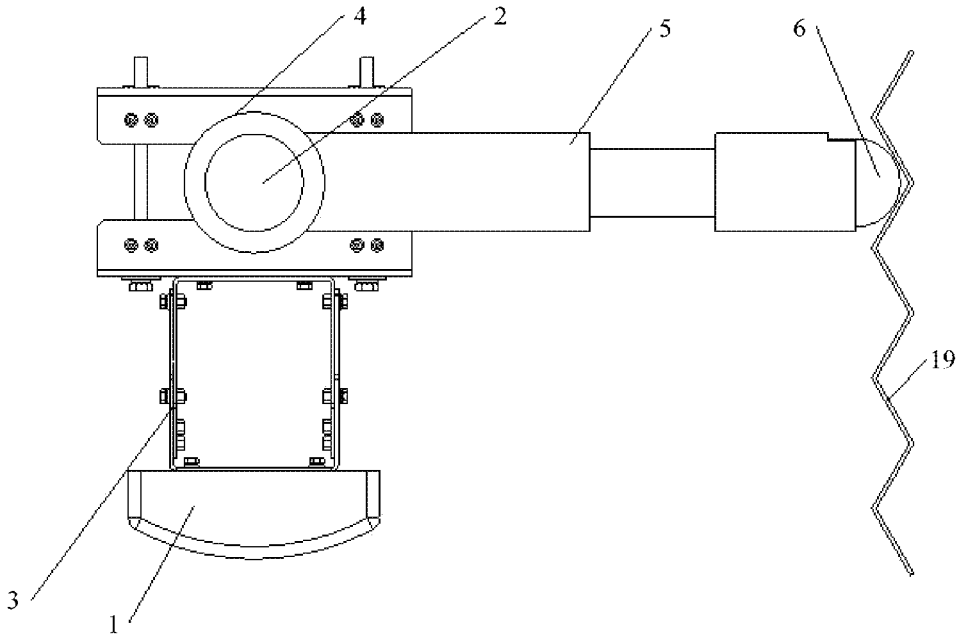
FIG. 4 is a top view of the device for reducing interference among antennas of multiple base stations as shown in FIG. 3.

FIG. 3 or 4 is a structural diagram of a device for reducing interference among antennas of multiple base stations according to the present disclosure, in which the shielding apparatus is placed on the holding pole.

According to the embodiment, the shielding apparatus further includes: a stretchable shielding plate 19; a first bracket 5 coupled to the holding pole 2, wherein the first bracket is capable of sliding along an exterior of the holding pole; and a rotation shaft 6 placed on the shielding plate, wherein the rotation shaft is hinged to the first bracket. Furthermore, in the embodiment, the structure of the shielding plate in the shielding apparatus varies from that in embodiment one, whereas structures of other components are all the same as those in embodiment one. Therefore, merely a description for the structure of the shielding plate is disclosed herein, whereas other structures shall not be described again.

According to the embodiment, as shown in FIG. 3, the shielding plate 19 is a folded plate along the x-axis, which has an adjustable length. It is possible to fine-tune its size in view of requirements, meanwhile the size in fine-tuning is subject to a premise that a main propagation direction of signals will not be influenced. According to the embodiment, the shielding plate may further be a shielding plate with a feature of frequency selection, which is made of a metal material with a feature of shielding electromagnetic waves, or is made of an absorbing material with a feature of absorbing electromagnetic waves. The shielding plate is fixedly coupled with the rotation shaft in an adhesive manner or any other manners. Similarly, in order to optimize the tuning performance of the shielding plate, a length of the shielding plate is 50%~80% of a length of the radome. Preferably, the length of the shielding plate is 67% of the length of the radome.

Embodiment Three

Figure 5:
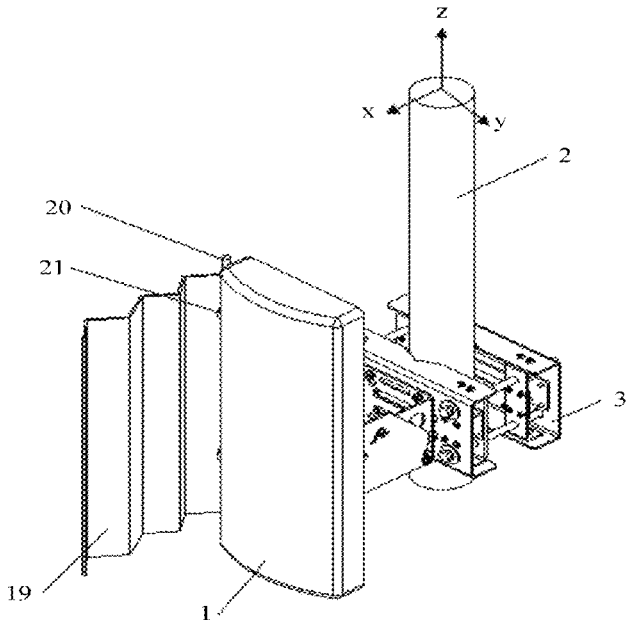
FIG. 5 is a structural diagram of a device for reducing interference among antennas of multiple base stations according to embodiment three of the present disclosure.
Figure 6:
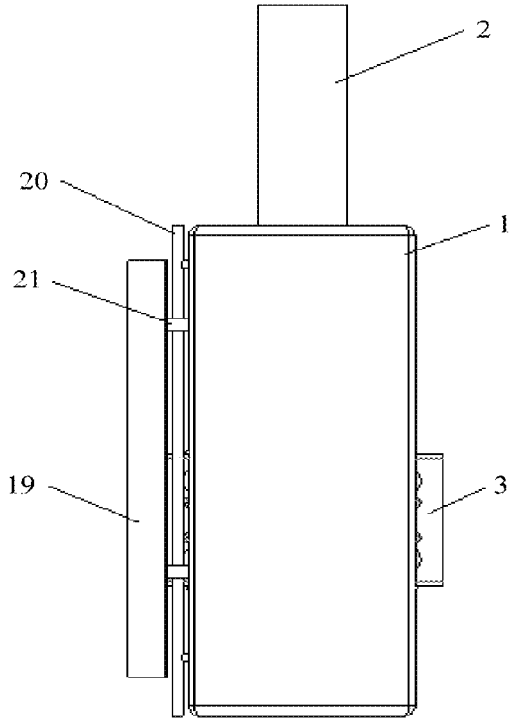
FIG. 6 is a front view of the device for reducing interference among antennas of multiple base stations as shown in FIG. 5.
Figure 7:
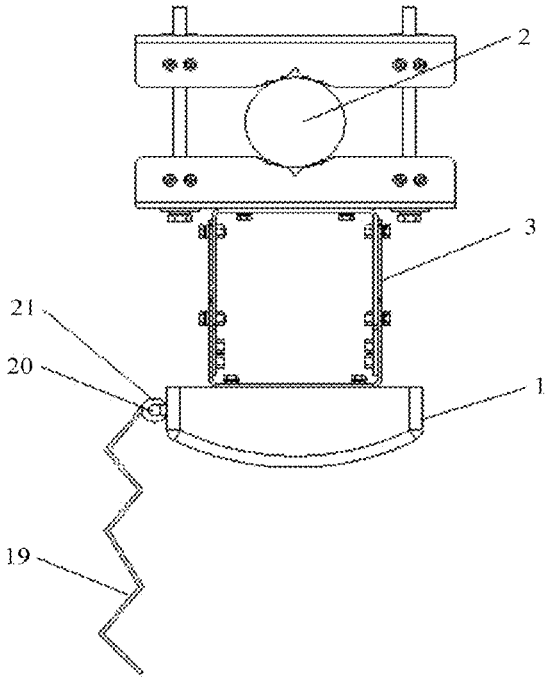
FIG. 7 is a top view of the device for reducing interference among antennas of multiple base stations as shown in FIG. 5.

FIG. 5-7 are structural diagrams of a device for reducing interference among antennas of multiple base stations according to the present disclosure, in which the shielding apparatus is placed on the holding pole.

In the embodiment, the shielding apparatus further includes: a stretchable shielding plate 19; a second bracket 20 placed on the antenna module 1; and a connection sleeve 21 placed on the shielding plate, where the connection sleeve 21 is rotationally coupled to the second bracket.

Specifically, as shown in FIG. 5-7, according to the embodiment, the second bracket is placed on one side of the radome in the antenna module, and the second bracket is detachably coupled to the radome. It is possible to determine a relative position between the second bracket and the radome in accordance with usage in site. Preferably, the second bracket is a cylindrical shaft body that is made of an insulation material. A symmetric axis of the second bracket is in parallel with that of the holding pole. The connection sleeve is placed on the cylindrical shaft body and it can rotate around the cylindrical shaft body within the horizontal plane, thereby bringing along a fine-tuning with the shielding plate being fixedly coupled with it at a horizontal azimuth angle.

As shown in FIG. 5, according to the embodiment, the shielding plate 19 is a folded plate along the x-axis, whose transverse length is adjustable. It is possible to finely tune its size in view of requirements, meanwhile the size in fine-tuning is subject to a premise of not influencing a radiation pattern of the base station and optimally improving isolations among the antennas of the base stations. According to the embodiment, the shielding plate may be a shielding plate with a feature of frequency selection, which is made of a metal material with a feature of shielding electromagnetic waves, or is made of an absorbing material with a feature of absorbing electromagnetic waves. Similarly, in order to optimize the tuning performance of the shielding plate, a length of the shielding plate is 50%~80% of a length of the radome. Preferably, the length of the shielding plate is 67% of the length of the radome.

According to the embodiment, the shielding plate is fixedly coupled with the connection sleeve 21 in an adhesive manner using a sticky substance, or is fixedly coupled with the connection sleeve in other manners, as long as the manner in use can achieve reinforcement, windproof and prevention of ineffectiveness of the shielding apparatus due to execution of external forces. By way of fixedly coupling the shielding plate with the connection sleeve, the shielding plate can rotate around the cylindrical shaft body with the connection sleeve within the horizontal plane, thus acquiring an optimal tuning position.

Certainly, according to the embodiment, the shielding plate may consist of the two reticular plates (not shown in FIG. 5-7) according to embodiment one. What differs is that, the forward shielding plate 7 and the backward shielding plate 8 in the two reticular plates are overlapped with each other horizontally along the x-axis. It is possible to stretch the two reticular plates out horizontally in a push-and-pull manner in accordance with applications in site. In addition, when the two reticular plates are stretched out, a horizontal distance in the push-and-pull is finely tuned subject to a premise of not influencing a main beam pattern of the antennas of the base station and optimally improving isolations among the base stations.

Likewise, the backward shielding plate 8 or the forward shielding plate 7 is fixedly connected with the connection sleeve in an adhesive manner using a sticky substance, or is fixedly connected with the connection sleeve in other manners, as long as the manner in use can achieve reinforcement, windproof and prevention of ineffectiveness of the shielding apparatus due to execution of external forces. By way of fixedly coupling the backward shielding plate 8 or the forward shielding plate 7 with the connection sleeve, the shielding plates can rotate together with the connection sleeve around the cylindrical shaft body, thus acquiring an optimal tuning position.

Correspondingly, the forward shielding plate 7 and the backward shielding plate 8 may also be shielding plates with a feature of frequency selection, which are made of a metal material with a feature of shielding the electromagnetic waves, or are made of an absorbing material with a feature of absorbing the electromagnetic waves. Mesh sizes of the forward shielding plate 7 and the backward shielding plate 8 vary with the frequency bands. A shape of a mesh may be one or many of a square, a circle or any other geometric shapes. According to the present disclosure, in order to optimize the tuning performance of the shielding plate, a length of the shielding plate is 50%~80% of a length of the radome. Preferably, the length of the shielding plate is 67% of the length of the radome.

Although the aforementioned description describes the present disclosure in detail, the present disclosure is not limited thereto. A person skilled in the art can make amendments according to principles of the present disclosure. Therefore, any modification or variation according to the principles of the present disclosure is included within the protection scope of the present disclosure.

INDUSTRIAL APPLICABILITY

According to the embodiments of the present disclosure, a device for reducing interference among antennas of multiple base stations includes: an antenna module placed on a base station, and configured to transmit and receive radio waves; a holding pole placed on the base station, and configured to support the antenna module; a mounting bracket, coupled to the antenna module and the holding pole; and a shielding apparatus placed on the holding pole or the antenna module, and capable of being adjusted in directions. The structure of the device for reducing interference among antennas of multiple base stations provided by the present disclosure is simple; it is easy to manufacture and install the device; it can be applied to the base station's antennas in network use. In addition, the device for reducing interference among antennas of multiple base stations can efficiently increase isolation among the antennas of the multiple base stations and reduce interferences among antennas of base stations.

What is claimed is:

1. A device for reducing interference among antennas of multiple base stations, comprising:

an antenna module placed on a base station, and configured to transmit and receive radio waves;

a holding pole placed on the base station, and configured to support the antenna module;

a mounting bracket, coupled to the antenna module and the holding pole; and a shielding apparatus placed on the holding pole or the antenna module, and is capable of being adjusted in directions;

wherein the shielding apparatus is an apparatus that absorbs or shields an electromagnetic wave;

the shielding apparatus comprises:

a stretchable shielding plate;

a first bracket coupled to the holding pole, wherein the first bracket is capable of sliding along an exterior of the holding pole; and a rotation shaft placed on the shielding plate, wherein the rotation shaft is hinged to the first bracket.

2. The device according to claim 1, wherein the shielding plate is composed of a plurality of reticular plates, and adjacent reticular plates uses sliding connection, and one of the plurality of the reticular plates is fixedly coupled with the rotation shaft.

3. The device according to claim 1, wherein the shielding plate is a folded plate which has an adjustable length.

4. The device according to claim 1, wherein the shielding apparatus comprises:

a stretchable shielding plate;

a second bracket placed on the antenna module; and a connection sleeve placed on the shielding plate, wherein the connection sleeve is rotationally coupled to the second bracket.

5. The device according to claim 4, wherein the shielding plate is a folded plate which has an adjustable length.

6. The device according to claim 2, wherein the shielding plate is made of a metal material or an absorbing material.

7. The device according to claim 2, wherein a length of the shielding plate is 50%~80% of a length of a radome.

8. The device according to claim 2, wherein the first bracket is a stretchable bracket, and one end of the first bracket is equipped with a fixed sleeve placed on the holding pole.

9. The device according to claim 3, wherein the shielding plate is made of a metal material or an absorbing material.

10. The device according to claim 5, wherein the shielding plate is made of a metal material or an absorbing material.

11. The device according to claim 3, wherein a length of the shielding plate is 50%~80% of a length of a radome.

12. The device according to claim 5, wherein a length of the shielding plate is 50%~80% of a length of a radome.

13. The device according to claim 3, wherein the first bracket is a stretchable bracket, and one end of the first bracket is equipped with a fixed sleeve placed on the holding pole.

* * * * *